US011547623B2

(12) United States Patent
Kamath et al.

(10) Patent No.: US 11,547,623 B2
(45) Date of Patent: Jan. 10, 2023

(54) SYSTEM FOR LATCHING AN INFANT CARE STATION

(71) Applicant: GE Precision Healthcare LLC, Wauwatosa, WI (US)

(72) Inventors: Harish Kamath, Bengaluru (IN); Vernon Quadros, Bangalore (IN); Nagapriya Kavoori Sethumadhavan, Bangalore (IN); Mohanavenkatesh Thangavelu, Bengaluru (IN); Rajendra Naik, Bangalore (IN)

(73) Assignee: GE Precision Healthcare LLC, Wauwatosa, WI (US)

( * ) Notice: Subject to any disclaimer, the term of this patent is extended or adjusted under 35 U.S.C. 154(b) by 56 days.

(21) Appl. No.: 17/086,025

(22) Filed: Oct. 30, 2020

(65) Prior Publication Data

US 2022/0000695 A1 Jan. 6, 2022

(30) Foreign Application Priority Data

Jul. 1, 2020 (IN) ..... 202041027927

(51) Int. Cl.
*A61G 11/00* (2006.01)

(52) U.S. Cl.
CPC ..... *A61G 11/009* (2013.01); *A61G 11/003* (2013.01); *A61G 2203/16* (2013.01); *A61G 2203/20* (2013.01)

(58) Field of Classification Search
CPC .. A61G 11/007; A61G 11/006; A61G 11/005; A61G 2203/20; A61G 2203/16; A61G 11/009; A61G 11/003
USPC ..... 600/22
See application file for complete search history.

(56) References Cited

U.S. PATENT DOCUMENTS 6,234,954 B1 * 5/2001 Mackin ..... A61G 11/006 600/22
6,484,670 B2 * 11/2002 Honma ..... A61G 11/006 16/312
2015/0257957 A1 * 9/2015 Koch ..... A61F 7/00 600/22
2015/0300064 A1 * 10/2015 Edavana ..... E05D 7/1061 16/231
2017/0128301 A1 * 5/2017 Wakabayashi ..... A61G 11/006

* cited by examiner

*Primary Examiner* — Samuel G Gilbert

(57) ABSTRACT

An infant care station is described herein that can include a wall of the infant care station, wherein the wall includes a primary latch and at least one secondary latch that includes a hinge with at least one bottom pin and at least one top pin, wherein the infant care station is an incubator, a warmer, or a combination thereof. In some examples, one or more pin acceptors are proximate the hinge, wherein the one or more pin acceptors hold the at least one bottom pin and the at least one top pin of the hinge in a closed position of the wall, and wherein the at least one top pin of the wall is released from the one or more pin acceptors in response to a force applied to the wall.

17 Claims, 12 Drawing Sheets

100

200

300

400

406

400

406

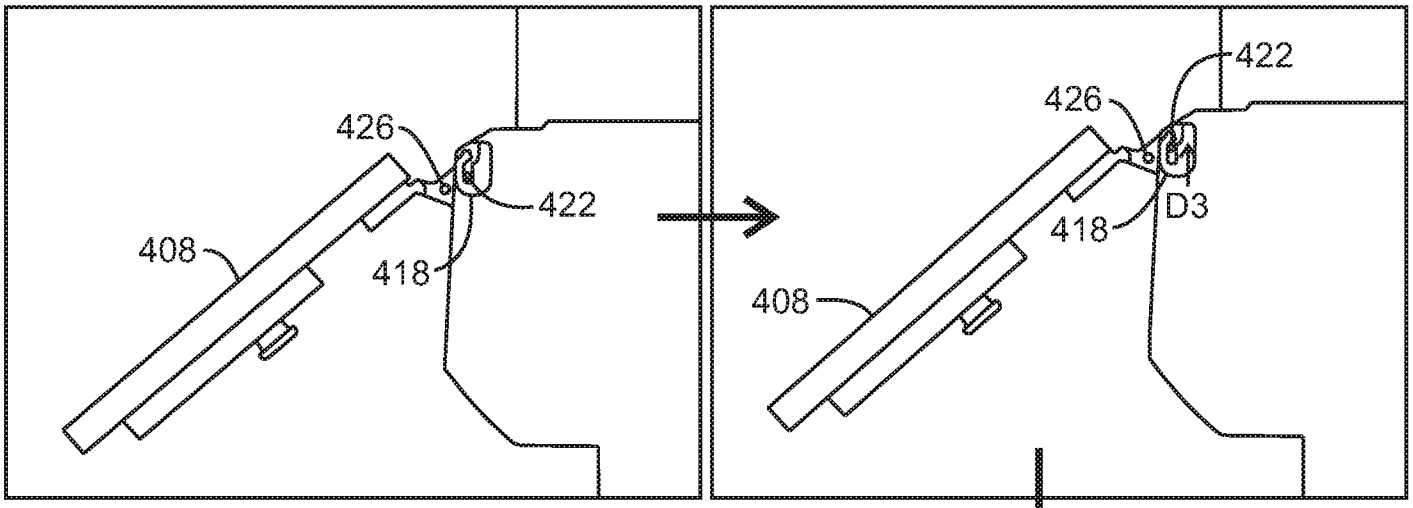
FIG. 7A
FIG. 7B
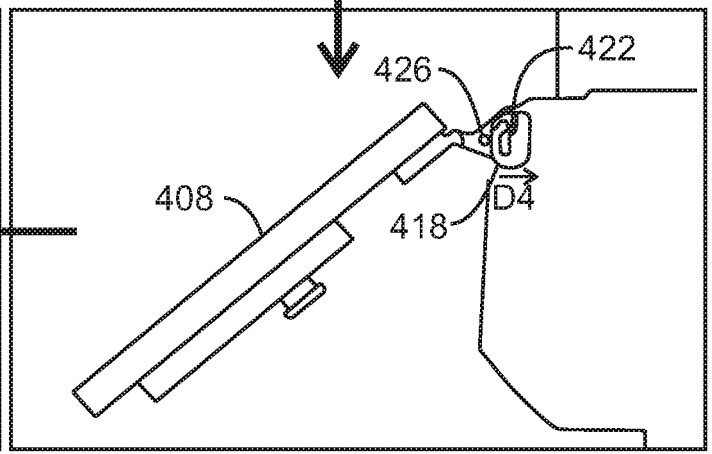
FIG. 7C
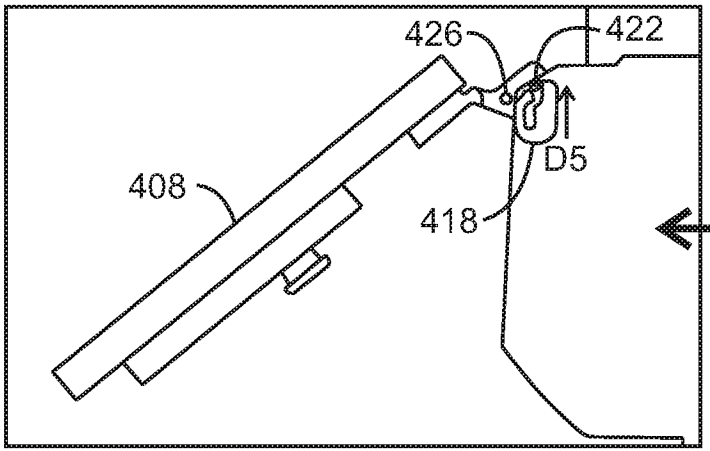
FIG. 7D

900

SYSTEM FOR LATCHING AN INFANT CARE STATION

CROSS-REFERENCE TO RELATED APPLICATION

This matter claims the benefit of the provisional Indian Patent Application 202041027927, filed Jul. 1, 2020, which is incorporated herein by reference in its entirety.

BACKGROUND

The present disclosure generally relates to an infant care station, such an incubator, an infant warmer, or a hybrid device, among others. Prematurely born infants can require specialized treatment and care due to their small size and still-developing organs and physiological systems. After being born, premature infants are typically placed in devices that create a carefully controlled micro-environment around the patient. The infant care station operates to control environmental conditions of the micro-environment, such as oxygen concentration, temperature, humidity and light in such a manner as to promote the health and well-being of the infant patient.

One type of infant care station is generally referred to as an incubator in which the patient is placed within a physical enclosure and the temperature within the enclosure is carefully controlled with convective heating provided by a forced flow of heated air into the enclosure. Within the micro-environment, the oxygen concentration and humidity can also be accurately controlled.

Another type of infant care station is referred to as a radiant warmer. The radiant infant warmer has an overhead canopy with heating elements that produce radiant heat directed downward onto the infant patient to maintain the temperature of the infant patient.

Hybrid systems are another type of infant care station that incorporates both convective heating systems and radiant heating systems.

Infant care stations typically include various components that enable controlling a micro-environment within the infant care stations. For example, the infant care stations can have multiple operational elements that are accurately controlled to maintain the micro-environment at desired levels. Further, the infant care stations can include one or more walls to maintain the micro-environment. In some examples, the infant care station can include any number of latches that enable the treating clinician to open and close a wall or a door of the infant care station.

SUMMARY

This summary introduces concepts that are described in more detail in the detailed description. It should not be used to identify essential features of the claimed subject matter, nor to limit the scope of the claimed subject matter.

The present disclosure relates to an infant care station that creates a micro-environment for an infant patient. The micro-environment region is located around the infant patient and is controlled by the infant care station. The patient in the infant care station can be accessed by opening and closing walls or doors of the infant care station. In some examples, a micro-environment platform includes an additional set of latches that provide a safety mechanism for opening and closing a wall or a door of the infant care station.

In an aspect, an infant care station is described herein that can include a wall of the infant care station, wherein the wall comprises a primary latch and at least one secondary latch comprising a hinge with at least one bottom pin and at least one top pin. The infant care station can be an incubator, a warmer, or a combination thereof. In some examples, one or more pin acceptors are proximate the hinge, wherein the one or more pin acceptors hold the at least one bottom pin and the at least one top pin of the hinge in a closed position of the wall. In some examples, the at least one top pin of the wall is released from the one or more pin acceptors in response to a pulling force applied to the wall.

In some aspects, the one or more pin acceptors each comprise a groove of a predetermined configuration, and wherein the force comprises an upward force, a pulling force, or a combination thereof. In some examples, the predetermined configuration comprises a higher region of the groove that is narrower than a lower region of the groove. In some aspects, the predetermined configuration comprises one or more regions of the groove that are narrower than at least one wider region of the groove.

In some examples, the top pin comprises a cylindrical shape and the bottom pin comprises at least one flat edge. In some examples, a second force in an upward direction applied to the wall in an open position results in the one or more bottom pins moving upward in the one or more pin acceptors, and wherein the wall is detached from the infant care station in response to the one or more bottom pins exiting a top of each of the one or more pin acceptors.

In an aspect, the hinge, the at least one bottom pin, or the at least one top pin comprises at least one section to break in response to a predetermined breaking force that exceeds a threshold. In some examples, the at least one bottom pin, the at least one top pin, or a combination thereof, comprises a single pin that is inserted into a hollow space of the hinge. In some aspects, the at least one bottom pin comprises a first bottom pin on a first side of the hinge and a second bottom pin on a second side of the hinge, and wherein the at least one top pin comprises a first top pin on the first side of the hinge and a second top pin on the second side of the hinge. In some examples, the at least one bottom pin or the at least one top pin is a push-release type pin.

In another aspect, an infant care station can include a wall of the infant care station, wherein the wall comprises a primary latch and at least one secondary latch comprising a hinge with one or more hinge pins and a hook component. The infant care station can also include one or more pin slots proximate a fixed rod of a base of the infant care station, wherein the one or more pin slots house the one or more hinge pins. In some examples, the wall of the infant care station transitions from a closed position to an open position in response to a force applied to the wall, wherein the pulling force results in the one or more hinge pins moving in a first direction within the one or more pin slots and the hook component of the hinge releasing from the fixed rod. In some examples, the wall of the infant care station transitions from the open position to the closed position in response to a pushing force applied to the wall, wherein the pushing force results in the hook component of the hinge engaging the fixed rod and the one or more hinge pins moving in a second direction within the one or more pin slots.

In another aspect, an infant care station can include a wall of the infant care station, wherein the wall comprises a primary latch and a secondary latch comprising a hinge with at least one bottom pin and at least one top pin, wherein the infant care station is an incubator, a warmer, or a combination thereof. The infant care station can also include a pin acceptor proximate the hinge, wherein the pin acceptor houses the at least one bottom pin and the at least one top pin of the hinge in a closed position of the wall, wherein the at least one top pin of the wall is released from the pin acceptor in response to a pulling force applied to the wall, and wherein a second force in an upward direction applied to the wall in an open position results in the one or more bottom pins moving upward in the pin acceptor. In some examples, the wall can be detached from the infant care station in response to the one or more bottom pins exiting a top of the pin acceptor.

Various other features, objects, and advantages described herein will be made apparent from the following description taken together with the drawings.

BRIEF DESCRIPTION OF THE DRAWINGS

The drawings illustrate examples for implementing the techniques described herein. In the drawings:

FIGS. 7A, 7B, 7C, and 7D illustrate removing a wall from an infant care station;

DETAILED DESCRIPTION

Embodiments of the present disclosure will now be described, by way of example, with reference to FIGS. 1-9D. Infant care stations can provide microenvironments for infant patients receiving medical care. Infant care stations, as referred to herein, can include incubators, warmers, or devices that support one or more features of incubators and warmers. In some examples, the infant care stations can enable clinicians to access the patient by lowering one or more walls of the infant care stations. For example, a set of primary latches can be placed along a side of the walls of the infant care station, the top of the walls of the infant care station, or a combination thereof. The primary latches can be disengaged to lower the walls of the infant care station in order to access the infant patient. However, primary latches can be accidentally disengaged, and a wall can rotate to an open position with or without force from the infant patient.

Techniques described herein provide a set of secondary latches that prevent the accidental opening of a wall of an infant care station. In some examples, the set of secondary latches can prevent the wall of an infant care station from opening when the primary latches are inadvertently disengaged. An advantage that may be realized by the secondary latches feature in the practice of some examples of the described systems and techniques is an additional safety mechanism to prevent a wall of an infant care station from automatically opening, or opening with a minimal force, when the primary latches are disengaged. Techniques for engaging and disengaging the secondary latches are described in greater detail below in relation to FIGS. 1-9.

Figure 1:
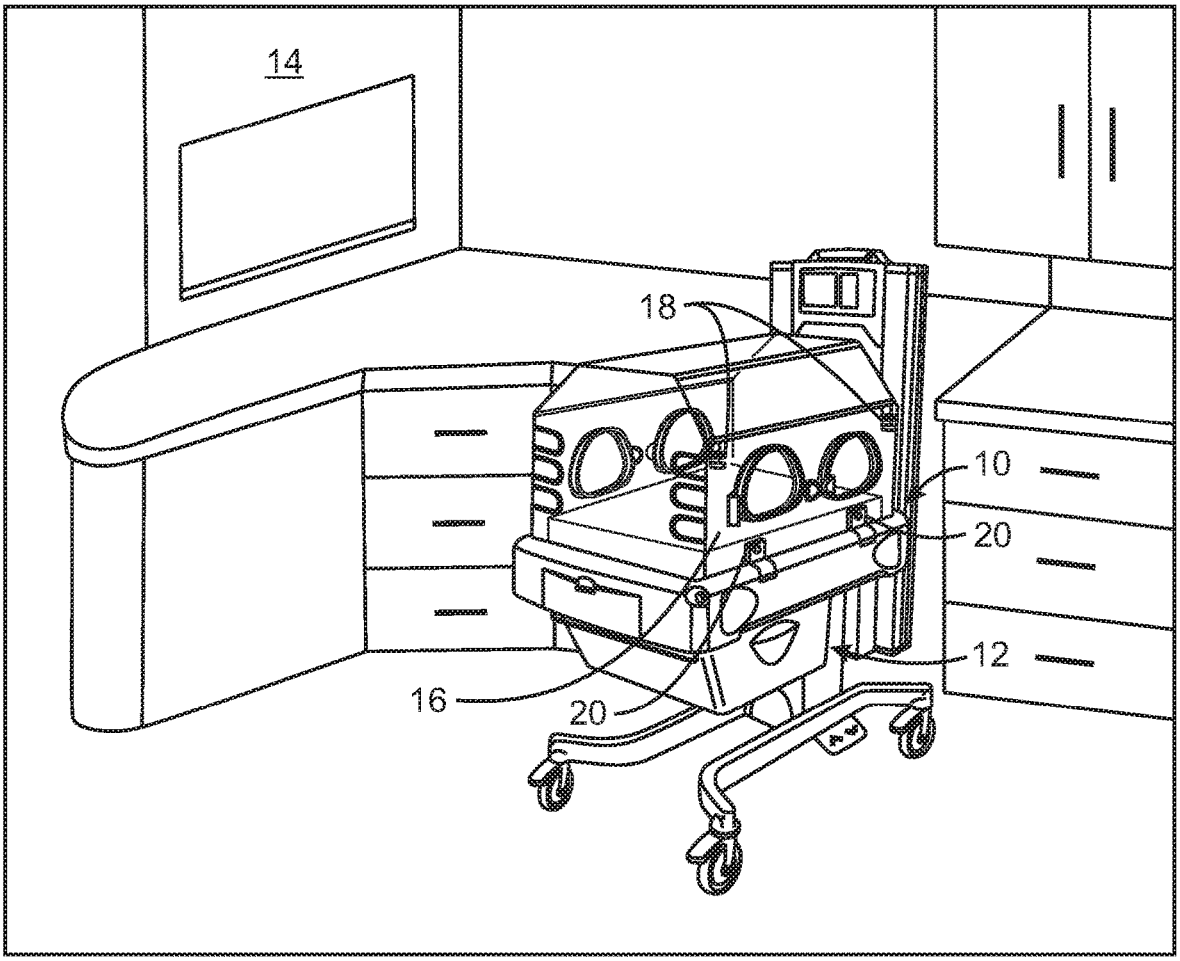
FIG. 1 is an environmental view that depicts an example type of an infant care station.

FIG. 1 depicts an environmental view of an infant care station 10. The infant care station 10 is depicted in this example as an incubator; however, it will be recognized and understood from the disclosure and examples given herein that alternative types of the infant care station 10 may include, but are not limited to, an incubator, a warmer, and a hybrid warmer/incubator apparatus, among others.

The infant care station 10 includes a mobile base 12 such that the infant care station 10 can be moved about a medical care facility, such as into a neonatal intensive care unit (NICU) 14. In the embodiment depicted in FIG. 1, the infant care station 10 includes a wall 16 that can serve as a door to access a patient in the infant care station 10. For example, the wall 16 can be released from the infant care station 10 via primary latches 18. In some examples, the wall 16 can remain in a closed position when the primary latches 18 are disengaged. For example, the wall 16 can rotate open in response to both the primary latches 18 and the secondary latches 19 being disengaged. The secondary latches 19 can provide an additional safety mechanism that prevents the wall 16 from accidentally opening with disengaged primary latches 18. Various secondary latches 19 are described below in relation to FIGS. 4-9.

Figure 2:
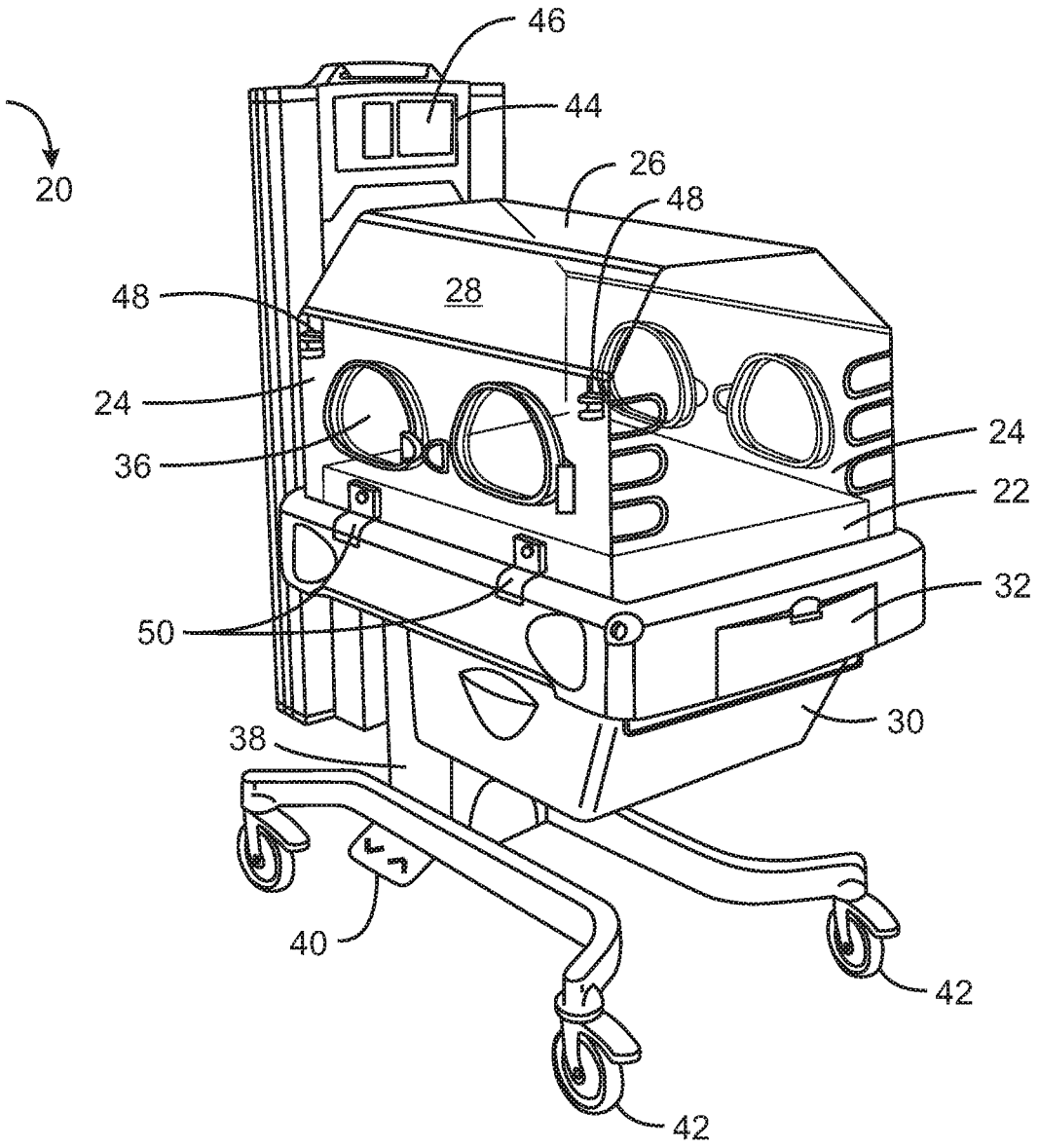
FIG. 2 depicts an example type of an infant care station.

FIG. 2 depicts an example of an infant care station in which the infant care station is an incubator 20. The incubator 20 includes a horizontal surface 22 that is configured to support an infant patient (not depicted). It is to be understood that the incubator 20 may have the ability or control to move, rotate, or incline the horizontal surface 22; however, it will be understood that the horizontal surface 22 will generally remain horizontal such as to minimize movement of the infant patient within the incubator 20 due to gravity.

One or more walls 24 extend generally vertically from the horizontal surface 22. In the embodiment depicted in FIG. 2 of the incubator 20, four walls extend vertically from the horizontal surface 22 to define the rectangular shape of the incubator 20. However, it will be understood that in alternative examples, various numbers of walls 24 may be used to define the incubator into various geometric shapes which may include, but are not limited to, circles or hexagons. The incubator 20 can further include a canopy 26 that extends over the horizontal surface 22. In some examples, as depicted in FIG. 2, the canopy 26 can include multiple components or surfaces, or, as depicted in FIG. 1, the canopy may be curved or domed in shape.

While the incubator of FIG. 2 is depicted with the horizontal surface 22, walls 24, and canopy 26 being integrally connected, it will be understood that in alternative examples, including those described in greater detail herein, the horizontal surface 22, walls 24, and canopy 26 may be individual components that also may be moveable with respect to each other.

The horizontal surface 22, walls 24, and canopy 26 can define a microenvironment 28 contained within these structures. In some examples, the incubator 20 is configured such that the microenvironment 28 surrounds the infant patient (not depicted) such that the infant patient is only exposed to a controlled combination of environmental conditions (temperature, humidity, O.sub.2 concentration, etc.) selected by a clinician to promote the health and wellbeing of the infant patient.

In some examples, the incubator 20 includes a base 30 that houses a convective heater 32. The convective heater 32 is operated such that air is drawn into the incubator 20, at which point the air may be filtered or sterilized in another manner, including the use of UV light before being passed by heating coils (not depicted) to heat the air to a target or set point temperature. The sterilized and heated air is blown into the microenvironment 28 through vents (not depicted) which are arranged along the walls 24. As is also known, the air may be entrained with supplemental gasses such as oxygen or may have added humidity such as to control these conditions within the microenvironment 28. In some examples, the walls 24 further include arm ports 36 that permit a clinician access into the microenvironment 28.

Embodiments of the incubator 20 further include a pedestal 38 connected to the base 30. The pedestal 38 includes mechanical components (not depicted), which may include, but are not limited to, servo motors, rack and pinion systems, or screw gear mechanisms that are operable by foot pedals 40 to raise or lower the base 30, effectively raising or lowering the position of the infant patient (not depicted) in relation to the clinician. As previously disclosed, the incubator 20 may be moveable by wheels or casters 42 connected to the pedestal 38.

The example of the incubator 20 depicted in FIG. 2 includes a graphical display 44 that is mounted to a wall 24, the base 30, or the canopy 26 of the incubator 20 at a position external to the microenvironment 28. The graphical display 44 is operated by a processor to present a graphical user interface (GUI) 46. In the example illustrated, the graphical display 44 is a touch-sensitive graphical display and the GUI 46 is configured to specifically respond to inputs made by a clinician received through the touch-sensitive graphical display. During normal operation, the touch-sensitive graphical display 44 and touch-sensitive configured GUI 46 are used to control various functions of the incubator 20. The GUI 46 presents a variety of information, such as the air temperature and alarm indications.

In some examples, the walls 24 of the incubator 20 can be opened or closed to enable a clinician to access a patient residing in the incubator 20. For example, the walls 24 can serve as doors that open and close to either remove a patient from the incubator 20 or to place a patient into the incubator 20. As described in greater detail below in relation to FIGS. 4-9, the walls 24 can include any number of primary latches 48 and secondary latches 50. In some examples, the primary latches 48 can be disengaged and the secondary latches 50 can remain engaged to prevent a wall 24 from opening. The secondary latches 50 can provide an additional security mechanism that prevents a patient from accidentally exiting the incubator 20 without a clinician's assistance. In some examples, a clinician can disengage both the primary latches 48 and the secondary latches 50 before a wall 24 of the incubator 20 can open to enable the clinician to access the infant patient.

Figure 3:
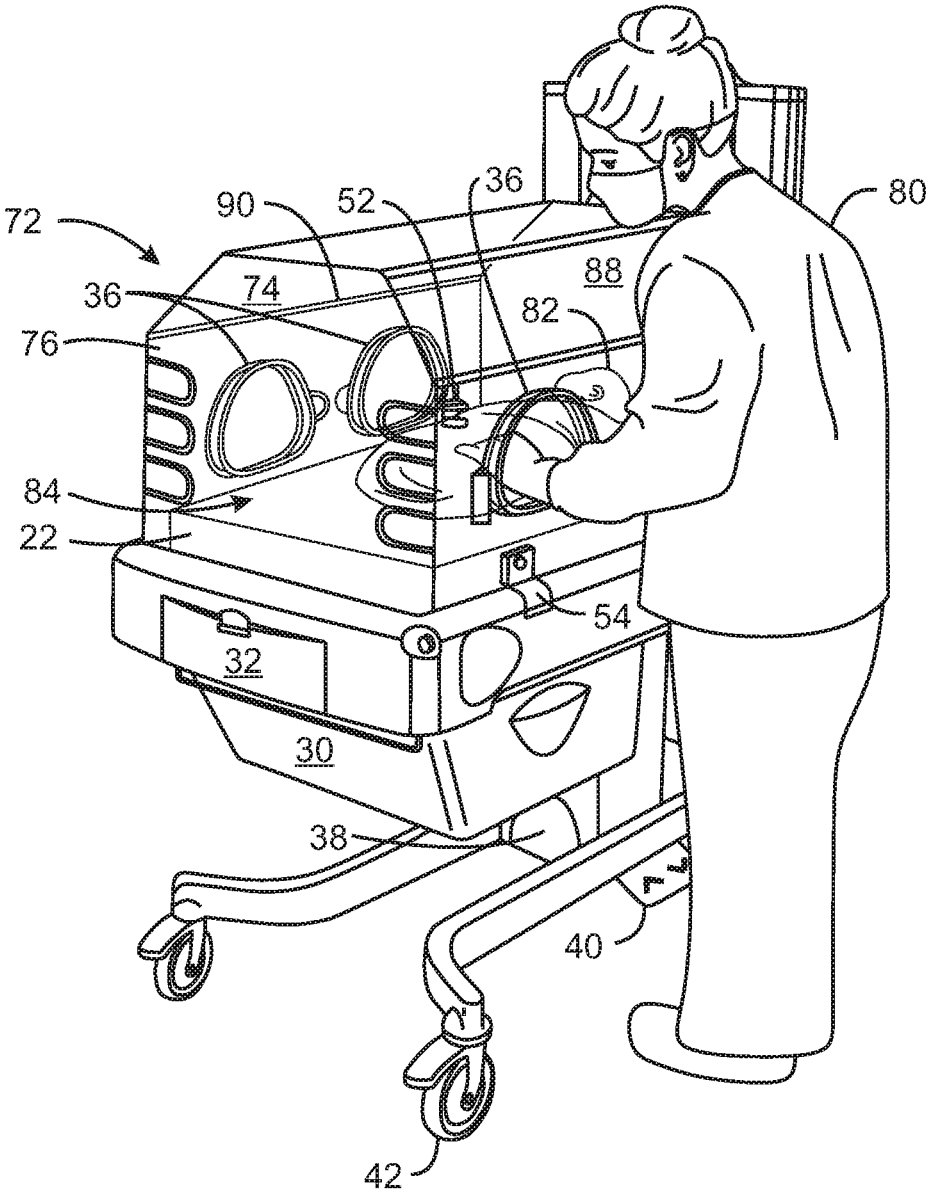
FIG. 3 depicts an additional example type of an infant care station.

FIG. 3 depicts another example of an infant care station in which the infant care station is a hybrid infant care station 72 that can functionally operate as either a warmer or an incubator. In a hybrid infant care station 72, the canopy 74 can be separate from the walls 76. The canopy 74 can be vertically moveable with respect to the walls 76 and the horizontal surface 22 on vertical rails 78. In some examples, the walls 76 can include one or more arm ports 36 through which the clinician 80 can access the infant patient 82 located in the microenvironment 84 defined by the horizontal surface 22, walls 76, and canopy 74. It will be recognized that like reference numerals will be used between like structures found in FIGS. 2 and 3 in order to promote efficiency in the description.

The hybrid infant care station 72 is operable between incubator and warmer modes. When the hybrid infant care station 72 operates as a radiant warmer, the canopy 74 may be vertically separated along the rail 78 along the horizontal surface 22, and a radiant heater 86 located in the canopy 74 produces radiant heat energy that is directed downward at the infant patient 82, and thereby operates to control the temperature of the infant patient 82. When the hybrid infant care station 72 operates as an incubator, the canopy 74 is moved vertically closer to the horizontal surface 22 and the infant patient 82 thereby enclosing or partially enclosing the infant patient 82 in conjunction with the walls 76. In operation as an incubator, the hybrid infant care station 72 may control the temperature of the infant patient 82 with a convective heater 32, while in other examples, the convective heater 32 and the radiant heater 86 may work in conjunction in order to effectively control the temperature of the infant patient 82.

The example of the hybrid infant care station 72 depicted in FIG. 3 includes a touch-sensitive graphical display 88 built into the canopy 74. In some examples, the graphical display 88 can provide a state of the primary latches 52, the secondary latches 54, or a combination thereof. For example, the state displayed via the graphical display 88 can indicate if the primary latches 52 and the secondary latches 54 are disengaged or engaged. As discussed in greater detail below, the secondary latches 54 can, in some examples, remain engaged when the primary latches 52 are disengaged.

FIGS. 4A-4F illustrate an example infant care station with sets of latches in open and closed positions. In the example illustrated in FIG. 4A, the infant care station 400 can include one or more primary latches 402, a handle 404, and one or more secondary latches 406. The primary latches 402 can be disengaged to open the wall 408 of the infant care station 400. In some examples, disengaging the primary latches 402 does not enable the wall 408 to transition from a closed position to an open position. For example, the set of secondary latches 406 that connect the wall 408 to the base 410 of the infant care station 400 can prevent the wall 408 from opening or rotating away from the infant care station 400. In some embodiments, the secondary latches 406 can be placed along the bottom of the wall 408 or at any other suitable location along the wall 408. The secondary latches 406 can include various components that enable the wall 408 to be connected to the base 410 of the infant care station 400. In some examples, the secondary latches 406 can include a connector 412 that enables the wall 408 to be connected to the secondary latches 406 via any suitable number of screws, bolts, or any other type of attaching component. In some examples, the handle 404 can enable a clinician to apply an upward force or a pulling force to the wall 408 to enable the wall 408 to open. The opening of the wall 408 is discussed in greater detail below in relation to FIGS. 5A-5D.

Figure 4A:
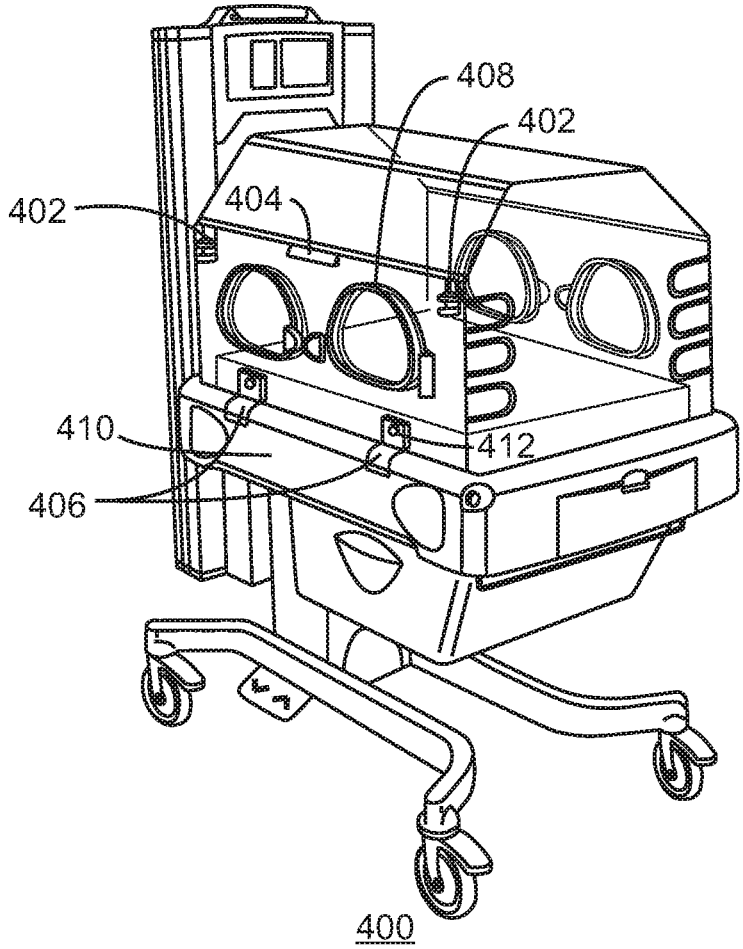
FIGS. 4A, 4B, 4C, 4D, 4E, and 4F illustrate an example infant care station with sets of latches in open and closed positions.
Figure 4B:
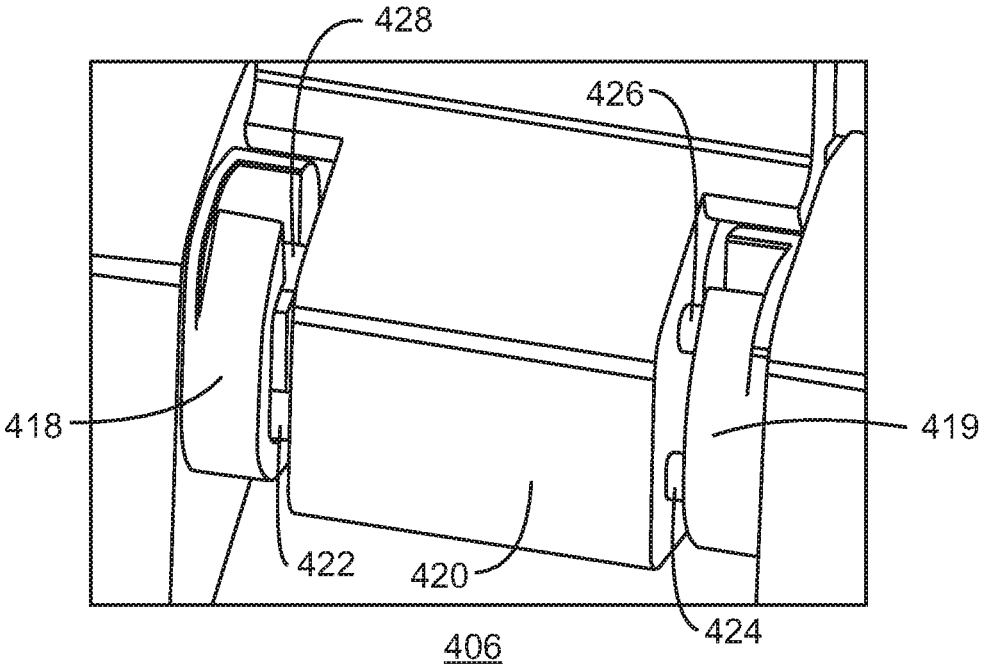

As illustrated in FIG. 4B, in some examples, the secondary latches 406 can include a hinge 420 that can include any number of hollow spaces (not depicted) in which one or more pins 422, 424, 426, and 428 can be inserted. In some embodiments, the hinge 420 can accept or include different types of pins 422, 424, 426, and 428. In some examples, the pins or rods 422, 424, 426, and 428 extend through the hollow spaces of the hinge 420 so that an exposed portion of the pins or rods 422, 424, 426, and 428 extend from both sides of the hinge 420. The hollow spaces of the hinge 420 can accept or receive a single pin, or any number of pins or rods 422, 424, 426, and 428. The exposed portions of the pins or rods 422, 424, 426, and 428 can be inserted into pin acceptors 418 and 419 fixed to the base of the infant care station 400. The pin acceptors 418 and 419 can include one or more grooves or slots with any suitable shape such as a vertical groove, a slanted groove, an "s" shaped groove, or a groove with any suitable number of curved or angular portions. As illustrated in FIGS. 5-9, the pin acceptors 418 and 419 can, in some examples, include a groove with a region that angles towards the base of the infant care station.

In some examples, the pins or rods 422, 424, 426, and 428 can be inserted into the groove of the pin acceptors 418 and 419 to allow the wall 408 of the infant care station 400 to be placed in an open position or a closed position. For example, one or more top pins 422 or 424 on each side of the secondary latch 406 can be disengaged to open a wall 408 attached to the hinge 420. In some examples, one or more bottom pins 426 or 428 can be disengaged to separate the wall 420 from the infant care station 400. For example, the top pins 422 and 424 can be disengaged from the pin acceptors 418 and 419 to enable the wall 408 to swing away from the infant care station 400 in an open position. In the open position, the bottom pins 426 and 428 can remain in the pin acceptors 418 and 419. In some examples, each secondary latch 406 can include one or more bottom pins 422 and 424 and one or more top pins 426 and 428. For example, the one or more bottom pins 422 and 424 and one or more top pins 426 and 428 can be placed in a configuration such that the one or more top pins 426 and 428 are released from the pin acceptors 418 and 419 in response to a lifting force, a pulling force, or a combination thereof, applied to the wall 408 attached to the secondary latch 406. The one or more top pins 426 and 428 and bottom pins 422 and 424 can be fixed or can rotate freely. The secondary latches 406 can prevent the wall 408 from fully opening. For example, the top pins 426 and 428 of the secondary latches 406 can remain in a groove (502 of FIG. 5A) of the pin acceptors 418 and 419 until a force is applied to the wall 408 to release the top pins 426 and 428 from the groove of the pin acceptors 418 and 419.

In some examples, each pin 422, 424, 426, and 428 is inserted into the pin acceptors 418 and 419. In some embodiments, the hinge 420 does not include a hollow space, but includes any number of pins 422, 424, 426, and 428 affixed to the hinge 420. For example, a hinge 420 can include two or more pins 422, 424, 426, and 428 attached to each side of the hinge 420. In some examples, each of the two or more pins 422, 424, 426, and 428 on each side of the hinge 420 can be inserted into a pin acceptor 418 or 419. In some embodiments, the hinge 420 can be manufactured using casting, three-dimensional printing, or any other suitable technique. The hinge 420 can be manufactured as a single component, in some examples, that includes the two or more pins 422, 424, 426, or 428 on each side of the hinge 420. In some examples, each side of the hinge 420 can include two, three, four, or any suitable number of pins. In some embodiments, the number of pins 422, 424, 426, and 428 on a first side of the hinge 420 can differ from the number of pins 422, 424, 426, and 428 on a second side of the hinge 420. For example, a first side of the hinge 420 can include two pins 422, 424, 426, or 428 and a second side of the hinge 420 may include three pins (not depicted).

In some examples, a top pin 426 or 428 can have any suitable shape, such as a cylindrical shape, among others. In some examples, a bottom pin 422 or 424 can also have any suitable shape, such as a shape that includes at least one flat edge, among others. The flat edge of the bottom pin 422 or 424 can provide an additional security mechanism by providing additional resistance to removing the bottom pin 422 or 424 from a groove in the pin acceptors 418 or 419. In some examples, the pin acceptors 418 or 419 can include any suitable configuration of one or more grooves or slots, which are described in greater detail below in relation to FIGS. 5-8. In some examples, the bottom pin 422 or 424 or the top pin 426 or 428 can be a push-release type pin, wherein the push-release type pin can be compressed with a squeezing force and placed into the grooves or slots before expanding.

In some embodiments, to open the wall 408, one or more primary latches 402 on the top of the wall 408 can be disengaged. In some examples, a handle (404 of FIG. 4A) is affixed to the top of the wall 408, the center of the wall 408, or in any other suitable location. An upward pushing force D1 applied to the handle 404 combined with a pulling force D2 away from the infant care station 400 can enable the top pins 426 and 428 to move up within the pin acceptors 418 and 419. As the top pins 426 and 428 move up within the pin acceptors 418 and 419, the top pins 426 and 428 can rotate away from the infant care station 400 in response to a pulling force D2 applied to the wall 408. In some examples, the top pins 426 and 428 can rotate and move out of the pin acceptors 418 and 419 with a pulling force greater than a predetermined threshold, wherein the pulling force is applied to the wall 408 without an upward force applied to the handle 404 of the wall 408.

Figure 4C:
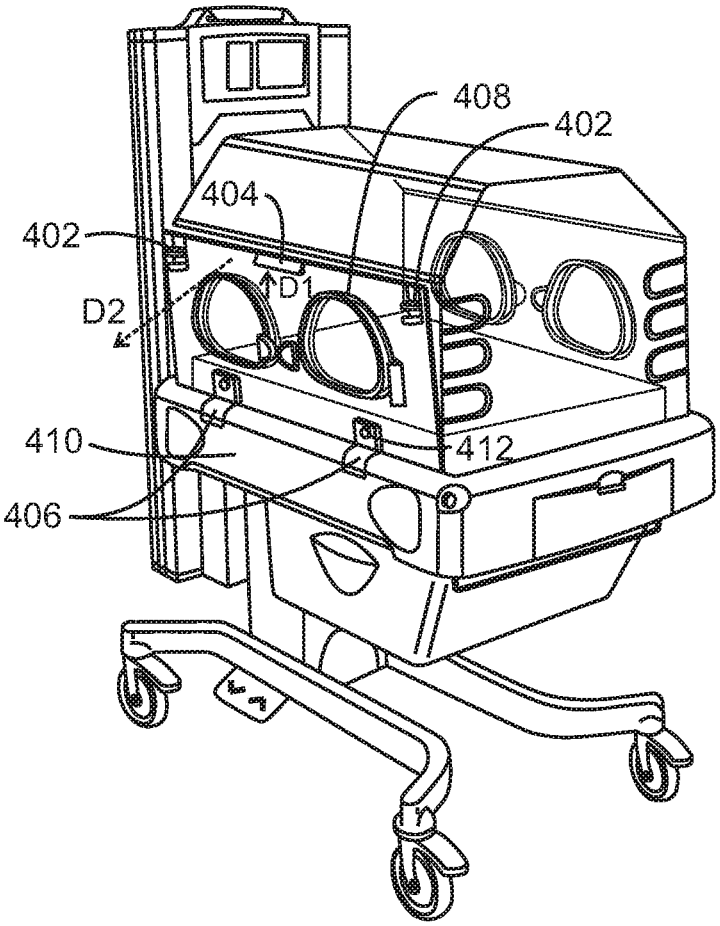

In the example of FIG. 4C, the wall 408 of the infant care station 400 is illustrated in a partially opened position. In the partially opened position, the top of the wall 408 extends away from the infant care station 400 as the primary latches 402 are released or disengaged. In some examples, the bottom pins 422 and 424 and the top pins 426 and 428 can move upward in the groove of the pin acceptors 418 and 419. For example, a pulling force, an upward force, or a combination thereof applied to a handle 404 of the infant care station 400 can result in the bottom pins 422 and 424 and top pins 426 and 428 moving upward within the pin acceptors 418 and 419.

Figure 4D:
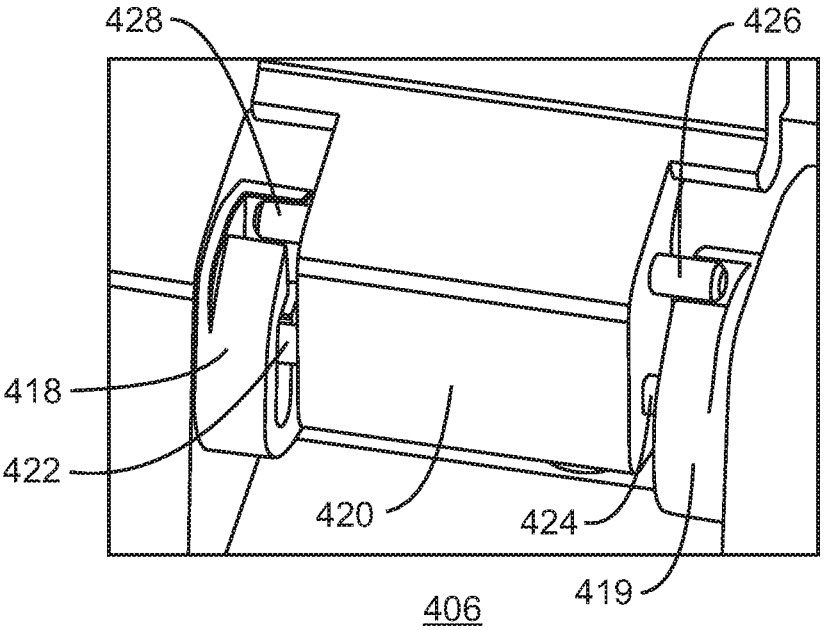

As illustrated in FIG. 4D, in some examples, in a partially opened position, the top pins 426 and 428 can be positioned above the top of the pin acceptors 418 and 419. The top pins 426 and 428 can exit the top of the pin acceptors 418 and 419 in response to a pulling force or upward force applied to the wall 408. In some examples, the top pins 426 and 428 can further rotate away from the infant care station 400 as the wall 408 is further opened as illustrated in FIGS. 4E and 4F.

Figure 4E:
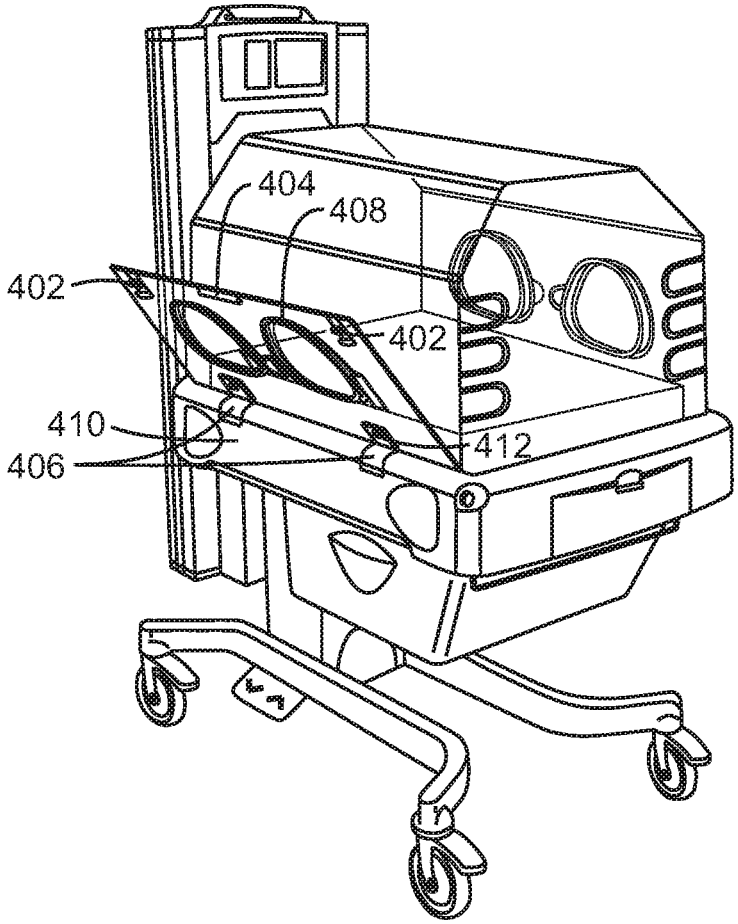

In the example of FIG. 4E, the wall 408 of the infant care station 400 is illustrated in an opened position where the wall 408 extends away from the infant care station 400 at approximately a 30 degree angle. In some examples, the wall 408 can be opened at any suitable angle.

Figure 4F:
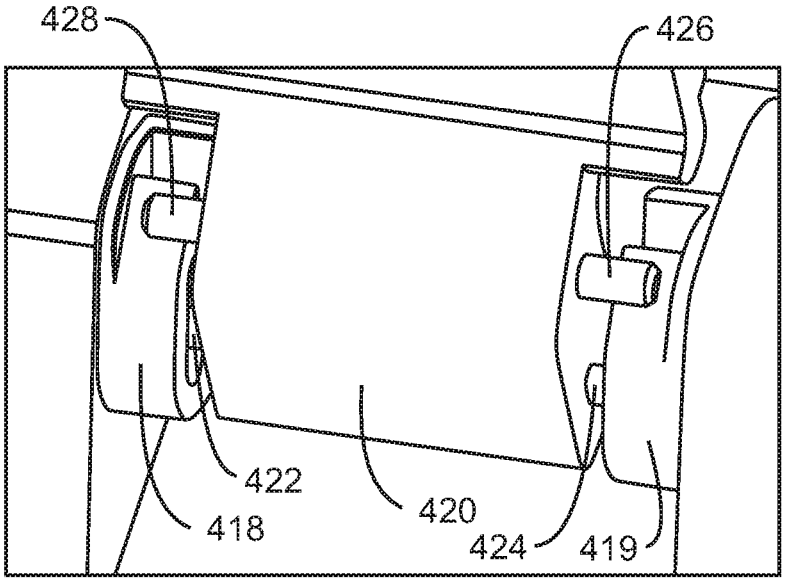

As the wall 408 is opened, the top pins 426 and 428 can move proximate the pin acceptors 418 and 419 as described in relation to FIG. 4F. For example, in FIG. 4F, the top two pins 426 and 428 rotate farther away from the infant care station 400 along the top of the pin acceptors 418 and 419. In some examples, the top pins 426 and 428 can rotate in a downward direction along the outside edge of the pin acceptors 418 and 419 until the wall 408 is fully open. As discussed below in greater detail in relation to FIGS. 5, 6, and 7, the wall 408 of the infant care station 400 can also be closed or removed from the infant care station 400 by manipulating the position of the pins 422, 424, 426, and 428 in relation to the pin acceptors 418 and 419.

Figures 5A, 5B, 5C, 5D:
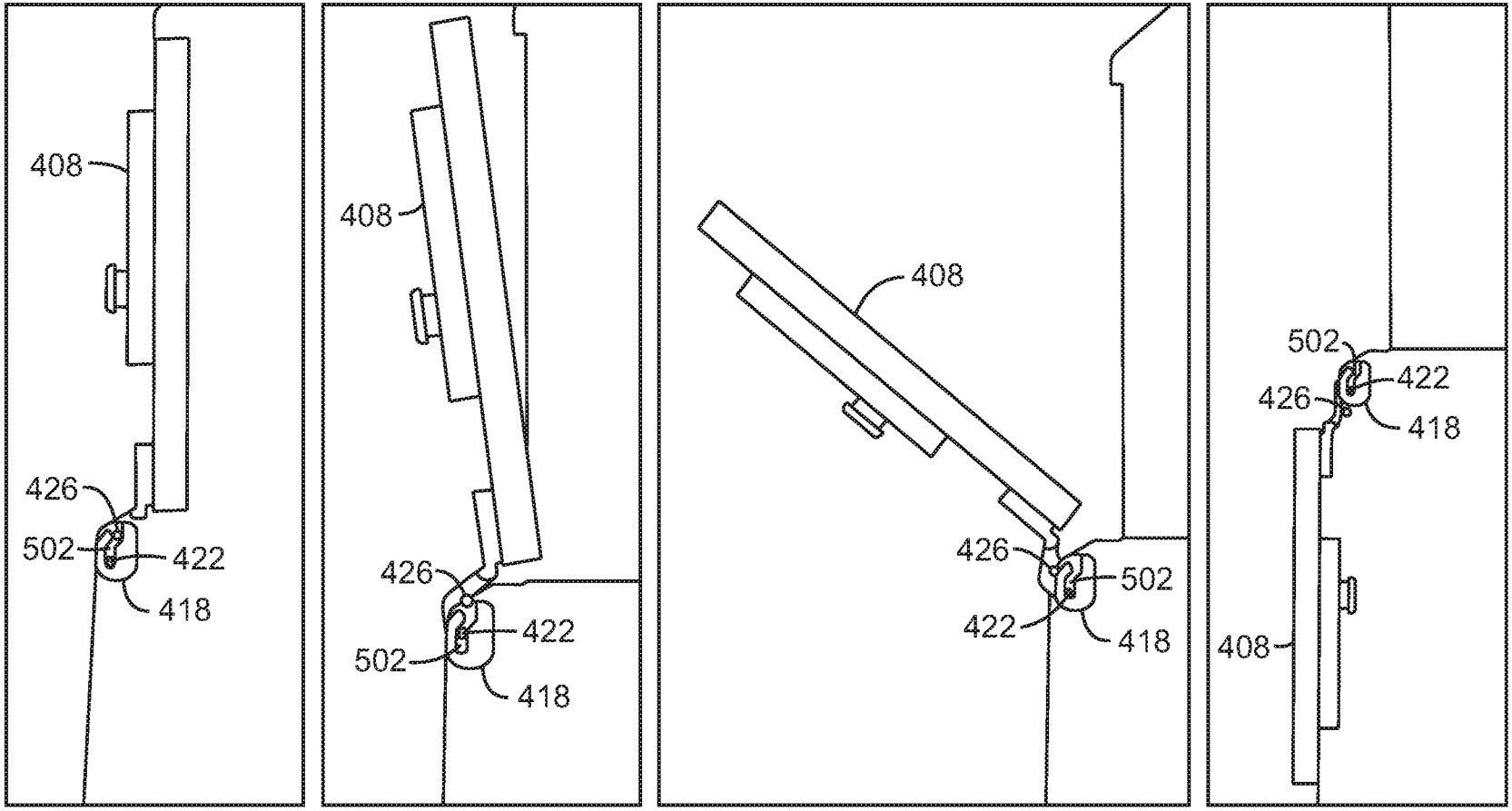
FIGS. 5A, 5B, 5C, and 5D illustrate various positions of a wall being opened for an infant care station with sets of latches.

It is to be understood that the example infant care station 400 of FIGS. 4A-4F can include any suitable number of fewer or additional components. For example, the infant care station 400 can include a first bottom pin 422 on a first side of the hinge 420 and a second bottom pin 424 on a second side of the hinge 420. The infant care station 400 can also include a first top pin 426 on the first side of the hinge 420 and a second top pin 428 on the second side of the hinge 420. In some examples, the infant care station 400 can include any number of additional pins or rods, fewer pins or rods, additional hinges, and additional pin acceptors, among others FIGS. 5A-5D illustrate various positions of a wall being opened for an infant care station with sets of latches. In FIG. 5A, the wall 408 of the infant care station is in a closed position. The bottom pin 422 and the top pin 426 of the secondary latch 406 are located within a groove 502 of the secondary latch 406. In the example of FIG. 5A, The bottom pin 422 and the top pin 426 of the secondary latch 406 are prevented from exiting the groove 502 without an upward force being applied to the wall 408.

FIG. 5B illustrates a second position of the pins within the secondary latch as the wall is opening. In some examples, once the primary latches 402 are disengaged, an upward force can cause the top pins 426 and 428 of the secondary latches 406 to exit the pin acceptors 418 and 419. For example, the top pins 426 and 428 of the secondary latches 406 can be raised, in response to the upward force, higher than the front edge 504 of the pin acceptors 418 and 419.

FIG. 5C illustrates a third position of the pins within the secondary latches as the wall is opening. In some examples, as the top pins 426 and 428 of the secondary latches 406 exit the top of the pin acceptors 418 and 419, the wall 408 affixed to the secondary latches 406 can open and rotate away from the infant care station 400.

FIG. 5D illustrates a fourth position of the pins of the secondary latches as the wall is opening. In some examples, the bottom pins 422 and 424 remain in the groove 502 of the pin acceptors 418 and 419 as the top pins 426 and 428 rotate with the wall 408 to a position below the pin acceptors 418 and 419. For example, the top pins 426 and 428 can rotate away from the infant care station 400 in a downward direction until a bottom portion of the wall 408 contacts the base of the infant care station 400.

FIGS. 6A-6D illustrate an example of a wall being closed for an infant care station with sets of latches. In some embodiments, to close the wall 408, a force can be applied to the wall to rotate the wall from position 1 to position 4 of FIGS. 6A, 6B, 6C, and 6D.

Figure 6D:
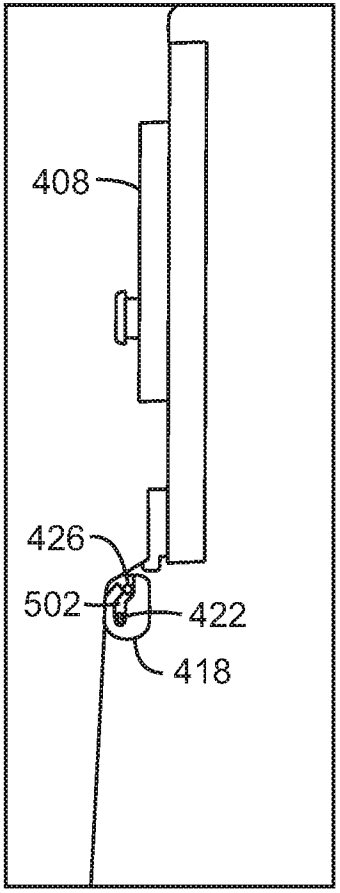
FIGS. 6A, 6B, 6C, and 6D illustrate a wall being closed for an infant care station with sets of latches.
Figure 6C:
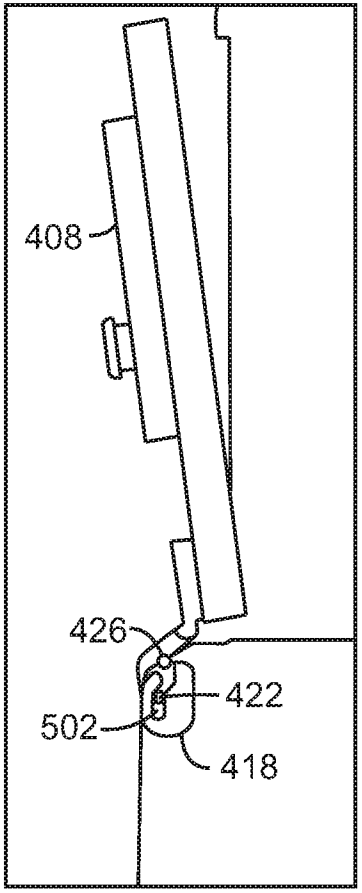
Figure 6B:
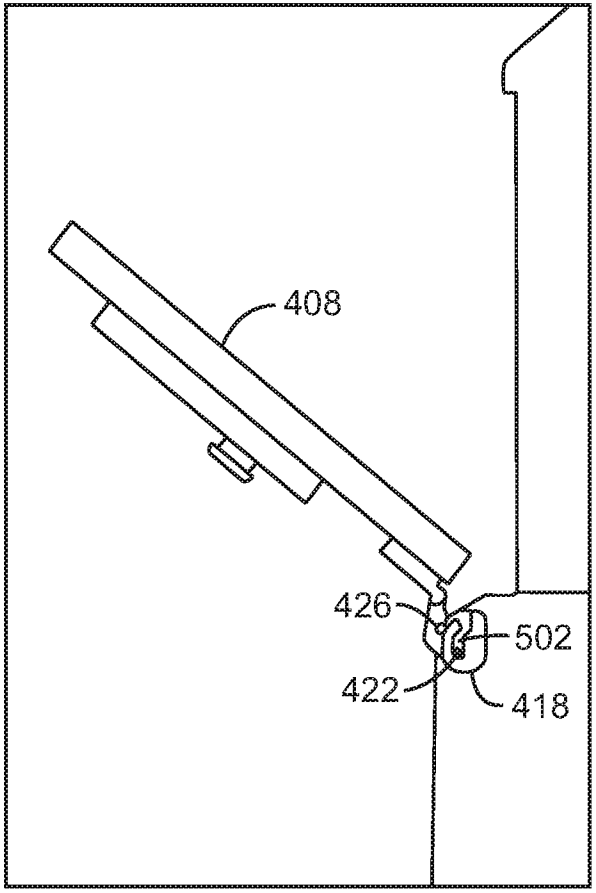
Figure 6A:
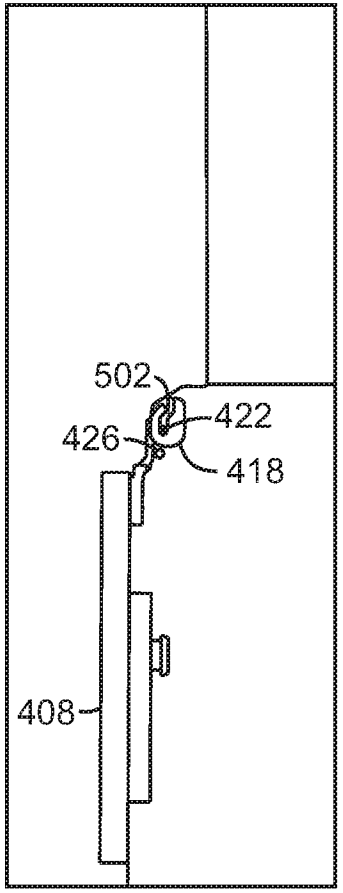

FIG. 6A illustrates an example first position of the pins 422, 424, 426, and 428 of the secondary latches 406 as the wall 408 is closing. In some examples, the bottom pins 422 and 424 remain in the grooves 502 of the pin acceptors 418 and 419 as the top pins 426 and 428 rotate with the wall 408 to a position below the pin acceptors 418 and 419. As illustrated in FIGS. 6B, 6C, and 6D, as the wall 408 rotates in an upward direction, the bottom pins 422 and 424 can rotate in the pin acceptor 418 and 419. The top pins 426 and 428 can rotate until the top pins 426 and 428 contact a top portion of the pin acceptors 418 and 419. A pushing force applied to the wall 408 can result in the top pins 426 and 428 sliding into the grooves 502 of the pin acceptors 418 and 419 before the top pins 426 and 428 drop or move in a downward direction into the grooves 502 to engage the secondary latch locking mechanism.

FIG. 6B illustrates an example second position of the pins within the secondary latches as the wall is closing. In some examples, the top pins 426 and 428 of the secondary latches 406 can rotate in an upward direction proximate the outer edge of the pin acceptors 418 and 419 as the wall 408 is closing. The wall 408 affixed to the secondary latches 406 can begin to transition from an open position to a closed position as the wall 408 rotates towards the infant care station 400.

FIG. 6C illustrates an example third position of the pins within the secondary latches as the wall is closing. In some examples, an upward force, a pushing force towards the infant care station 400, or a combination thereof, can cause the top pins 426 and 428 of the secondary latches 406 to move toward the grooves 502 in the pin acceptors 418 and 419. For example, the top pins 426 and 428 of the secondary latches 406 can make contact and slide along the top of the pin acceptors 418 and 419 toward the grooves 502.

In the example of FIG. 6D, the wall 408 of the infant care station is in a closed position. In response to a force to close the wall 408, the top pins 426 and 428 of the secondary latches 406 enter the groove 502 of the secondary latch 406. The top pins 426 and 428 move in a downward direction in the groove 502 along with the bottom pins 422 and 424. In some examples, the bottom pins 422 and 424 and the top pins 426 and 428 of the secondary latches 406 are prevented from exiting the groove 502 without an upward force or a pulling force being applied to the wall 408.

In some embodiments, the secondary latches 406 can include any number of failure detection features. For example, the secondary latches 406 can include pins 422, 424, 426, and 428, pin acceptors 418 and 419, and hollow spaces (not depicted) of the hinge 420, among others, that can break when a predetermined breaking force applied to the secondary latches 406 exceeds a predetermined threshold. In some examples, the pins 422, 424, 426, and 428, pin acceptors 418 and 419, and hollow spaces (not depicted) of the hinge 420 can be manufactured from metal, plastic, or any other suitable material. One or more areas of the pins 422, 424, 426, and 428, pin acceptors 418 and 419, and hollow spaces (not depicted) of the hinge 420 can be manufactured to fail or break in response to a force above a predetermined threshold. The failure or breaking of the components of the secondary latch 406 can prevent opening or closing of the secondary latch 406, which provides a detectable safety indicator that the secondary latch 406 is to be repaired.

FIGS. 7A, 7B, 7C, and 7D illustrate an example technique for removing a wall from an infant care station. In the example of FIG. 7A, once the top pins 426 and 428 are removed from the pin acceptors 418 and 419 in an open wall position, the bottom pins 422 and 424 can be removed from the pin acceptors 418 and 419 to release the wall 408 from the infant care station 400. In the example of FIG. 7B, the bottom pins 422 and 424 move up within the pin acceptors 418 and 419 in response to an upward force applied to the wall 408 in direction D3. In some examples, the bottom pins 422 and 424 move or travel in an upward direction D3 within the pin acceptors 418 and 419 until the bottom pins 422 and 424 contact a curved or angled portion of the groove 502 in the pin acceptors 418 and 419.

FIG. 7C illustrates an example of a second force being applied to the wall of the infant care station to remove the wall. In some examples, the second force D4 applied to the wall 408 can move the bottom pins 422 and 424 around the curved or angled portion of the groove 502 in the pin acceptors 418 and 419. For example, the second force D4 can be a force towards the infant care station 400 that enables a third force D5 in an upward direction to release the wall 408 from the infant care station 400.

FIG. 7D illustrates an example of a wall being removed from the infant care station. Removing the wall from the infant care station can enable cleaning the wall, repairing the wall, or otherwise servicing the wall. In some examples, the third force D5 in an upward direction can release the wall 408 from the infant care station 400 by causing the bottom pins 422 and 424 to exit a top of the pin acceptors 418 and 419. In some examples, the shape of the bottom pins 422 and 424 can be based on a direction of force to be applied to the wall 408 to release the wall 408 from the pin acceptors 418 and 419. For example, the bottom pins 422 and 424 can have an elliptical cross section shape, cylindrical cross section shape, one or more flat edges, and the like. The wall 408 of the infant care station 400 can then be manipulated at a particular degree in relation to the infant care station 400 to enable the bottom pins 422 and 424 to be removed from the pin acceptors 418 and 419. For example, the wall 408 of the infant care station 400 may be at 10 degrees, 30 degrees, 45 degrees, or any other suitable angle in relation to the infant care station 400 before a force in an upward direction, such as D5, can cause the bottom pins 422 and 424 to travel in an upward direction in the pin acceptors 418 and 419. In some embodiments, a series of forces may be applied to the wall 408 in a sequence of directions to enable the bottom pins 422 and 424 to travel upward in the pin acceptors 418 and 419. For example, based on the shape of the bottom pins 422 and 424 and the configuration or shape of the pin acceptors 418 and 419, a first force may be applied to the wall 408 while the wall 408 is held at a first angle in relation to the infant care station 400 and then a second force may be applied to the wall 408 while the wall 408 is held at a second angle in relation to the infant care station 400. In some examples, the sequence of directions of forces used to remove the wall 408 from the infant care station 400 can be an additional technical feature and safety mechanism that prevents the wall 408 from accidentally being released from the infant care station 400.

In some examples, the pin acceptors 418 and 419 can have different predetermined configurations of slots or grooves 502. For example, a first pin acceptor 418 can have a first groove and a second pin acceptor 419 can have a different second groove. In some embodiments, the first groove of a pin acceptor 418 can be a hollow space without protrusions while a second groove of a pin acceptor 419 can have any number of protrusions. In some examples, the first pin acceptor 418 and second pin acceptor 419 with different grooves or slots can be located on either side of a hinge 420. In some examples, pin acceptors with a first groove can be on either side of a first hinge 420 and pin acceptors with a second groove can be on either side of a second hinge 420. The slots or grooves 502 can also have a predetermined configuration in which a higher region of the grooves 502 is narrower than a lower region of the grooves 502. In some examples, the predetermined configuration of the grooves 502 comprise one or more regions of the grooves 502 that are narrower than at least one wider region of the groove 502.

Figure 8B:
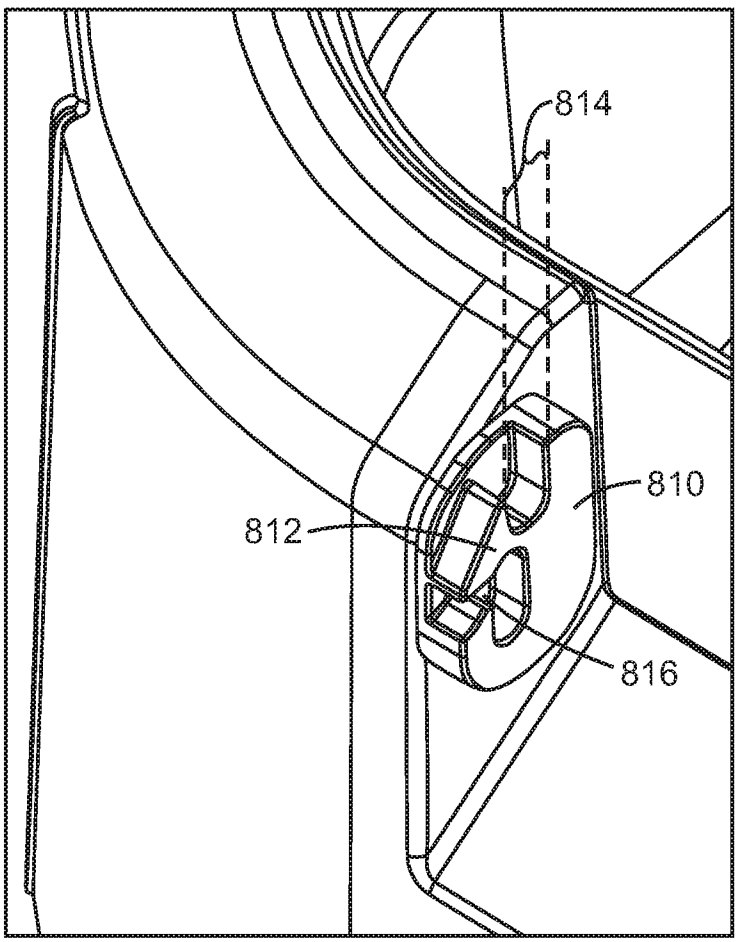
FIGS. 8A and 8B illustrate example configurations of the pin acceptors.
Figure 8A:
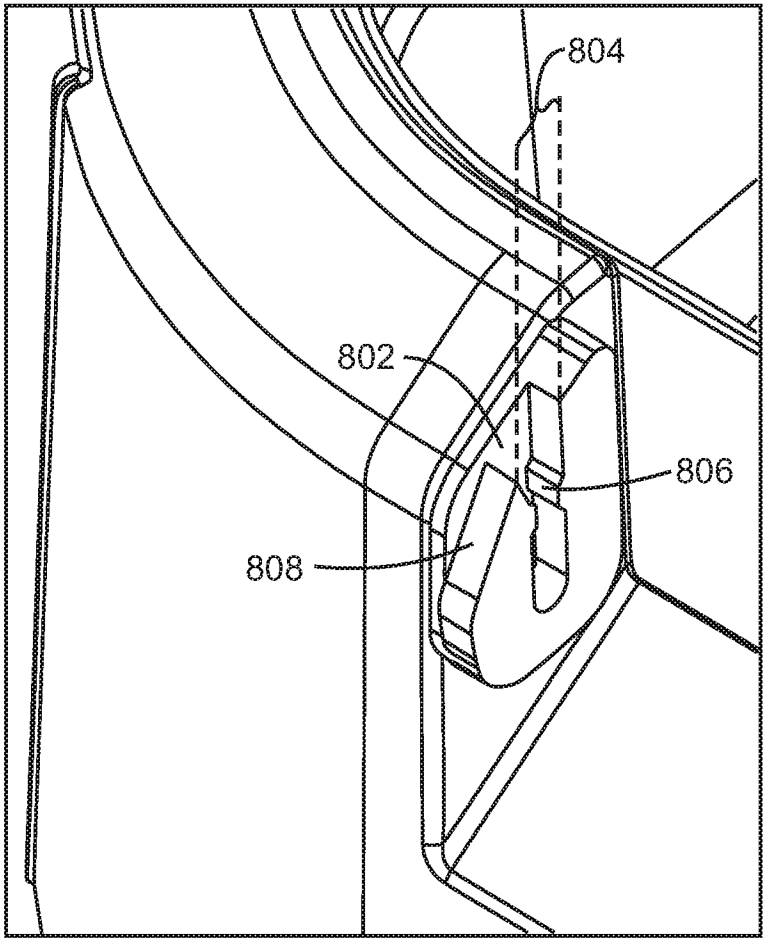

FIGS. 8A and 8B illustrate example configurations of the pin acceptors. As illustrated in FIG. 8A, in some examples, the pin acceptor 802 can include a slot or groove 804 with a protruding tab 806. The protruding tab 806 can be placed on either side of the slot or groove 804 at any suitable depth within the slot or groove 804. In some embodiments, the pin acceptor 802 can include an angled edge 808 that enables a top pin (not depicted) to be removed from the groove or slot 804 and to rotate proximate the angled edge 808 when a wall is opening. In some examples, the top pin (not depicted) can be pressed against the angled edge 808 when a wall is being closed. The top pin (not depicted) can be forced into the groove or slot 804 with a pushing motion applied against the door as the top pin (not depicted) of the wall slides in an upward direction along the angled edge 808. In some examples, the bottom pin (not depicted) of a wall can be released from the pin acceptor 802 of FIG. 8A with an upward force applied to a base of a wall in an open position.

FIG. 8B illustrates another example configuration of a pin acceptor. In some examples, the pin acceptor 810 includes a solid section or region 812 that separates a first groove 814 that accepts a top pin (not depicted) from a bottom groove 816 that accepts a bottom pin (not depicted). To open a wall, an upward force applied to the wall can release the top pin (not depicted) from the top slot or groove 814 of the pin acceptor 810 and the bottom pin (not depicted) can simultaneously rise upward in a bottom slot or groove 816. In some embodiments, to close a wall, a force is applied to the wall so that the wall rotates upward and toward the infant care station. The top pin can enter the top slot or groove 814 of pin acceptor 810 and the top pin can slide downward into the top slot or groove 816 of the pin acceptor 810 to lock the wall in a closed position. In some examples, to remove the wall from the infant care station, an upward force can be applied to the wall as the wall is opened. A second pulling force away from the infant care station can release the bottom pin (not depicted) of the wall from the pin acceptor 810. For example, the top pin of the wall is outside of the top slot of groove 814 when the wall is in an open position and an upward force applied to the wall followed by a pulling force applied to the wall can result in the bottom pin moving upward in the bottom slot or groove 816 and then outward away from the infant care station.

Figure 9A:
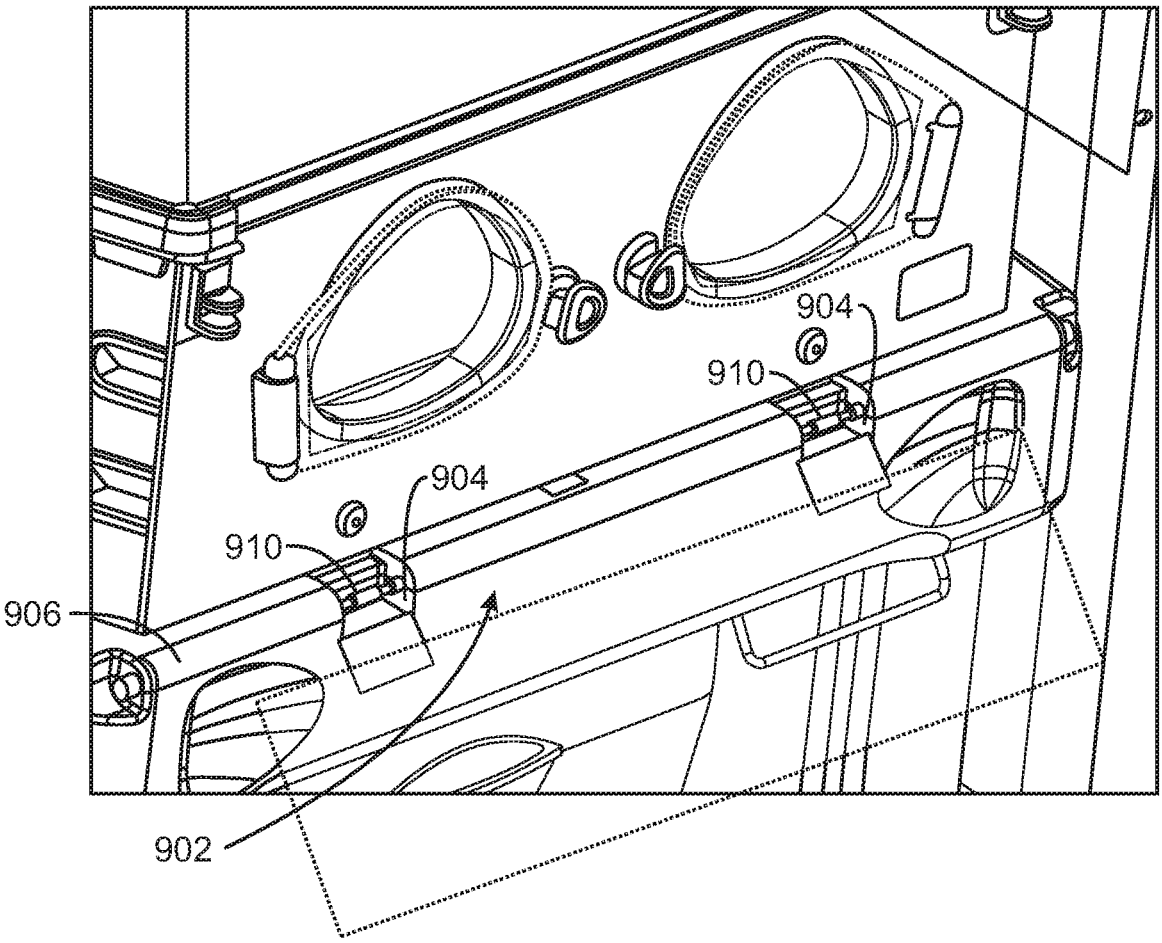
FIGS. 9A, 9B, 9C, and 9D are illustrations of an example infant care station modified to include sets of latches.

FIGS. 9A-9D are illustrations of an example infant care station modified to include sets of latches. In some embodiments, an existing infant care station can be modified to include one or more secondary latches. For example, one or more pin slots 902 illustrated in FIG. 9B can be added to the existing device proximate a fixed rod or pin. FIG. 9A illustrates an example infant care station 900 with a modified hinge axis 902. The modified hinge axis 902 enables additional pin slots 904 to be added to the base 906. The base 906 can also accommodate a modified hinge 908 described in greater detail below in relation to FIG. 9B. In some examples, pins or rods (not depicted) can move in a vertical or upward and downward range when the modified hinge 908 engages and disengages the fixed pin 910 as the wall is closed and opened.

Figure 9B:
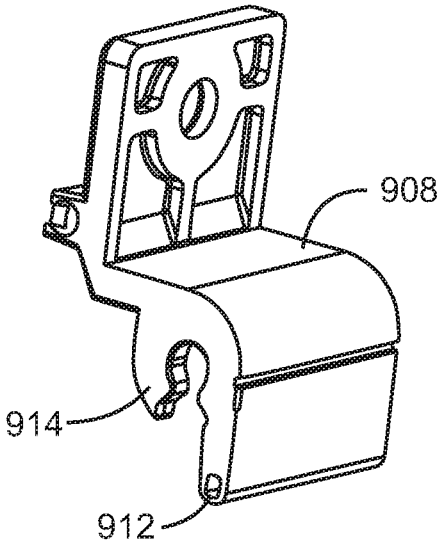

FIG. 9B illustrates an example modified hinge to connect a wall to a base of the infant care station. In some examples, the modified hinge 908 can include a hollow space 912 in which a pin can be inserted to connect the modified hinge 908 to the pin slots 904 illustrated in FIG. 9A. In some examples, one or more pins (not depicted) can be affixed to each side of the modified hinge 908, and the affixed pins (not depicted) can be placed within the pin slots 904. A hook component 914 of the modified hinge 908 can attach the modified hinge 908 to the fixed rod or pin 910 when a wall attached to the modified hinge 908 is closed. A force applied to the modified hinge 908 to open the wall can cause the hook component 914 to move upward, which releases the hook component 914 from the fixed rod or pin 910 and enables the wall to be opened.

Figure 9D:
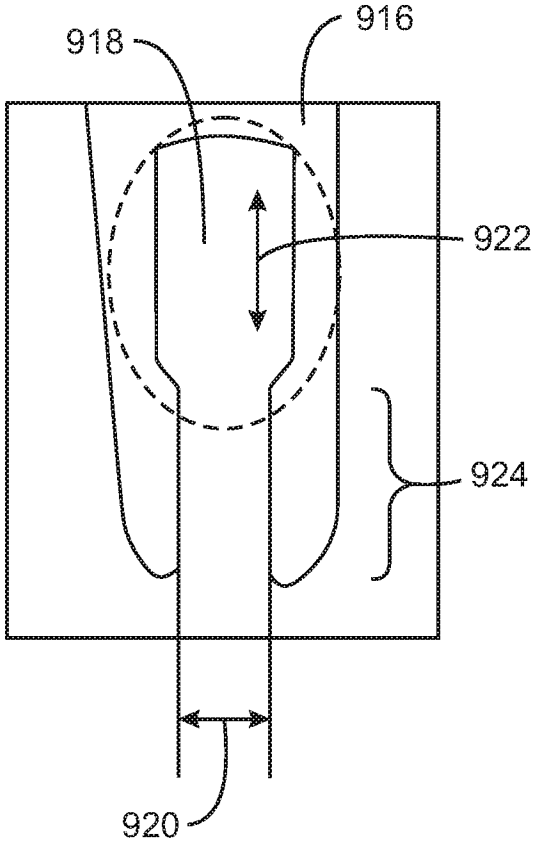
Figure 9C:
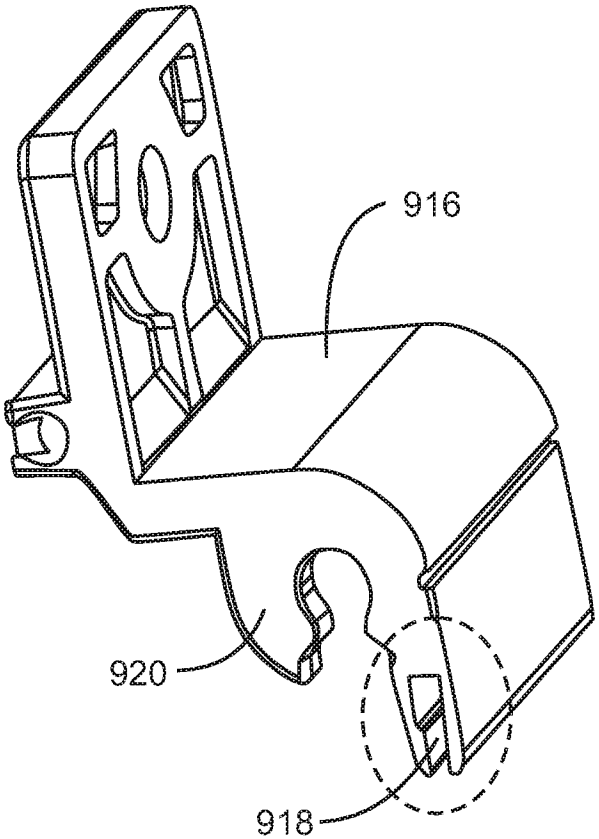

FIG. 9C is an example of a modified hinge to connect a wall of an infant care station to a base of the infant care station. In some examples, the modified hinge 916 can include a hollow space 918 in which a pin can be inserted to connect the modified hinge 916 to the pin slots 904 illustrated in FIG. 9A. A hook component 920 of the modified hinge 916 can attach the modified hinge 916 to the fixed rod or pin 910 of a base (906 of FIG. 9A) of an infant care station when a wall attached to the modified hinge 916 is closed. A force applied to the modified hinge 916 to open the wall can cause the hook component 920 to move upward, which releases the hook component 920 from the fixed rod or pin 910 and enables the wall to be opened. In some examples, the pins (not depicted) within the hollow space 918 of the modified hinge 916 can move upward and downward to enable the pins to engage and disengage the hook component 920.

FIG. 9D is a side perspective illustration of the example modified hinge of FIG. 9C. In some examples, the modified hinge 916 can include a hollow space 918 with a width 920 and a recessed opening with a height of 922. The recessed opening 924 enables the modified hinge 918 to move vertically around a pin (not depicted) as the wall (not depicted) attached to the modified hinge 916 is opened or closed. For example, as the modified hinge 916 opens to allow a wall to move away from an infant care station, the modified hinge 916 can move upward in the hollow space 918 to enable the hook component (920 of FIG. 9C) to be dislodged or disengaged from the fixed rod (910 of FIG. 9A). In some embodiments, the modified hinge 916 can include additional or alternative components. For example, ball bearings can be used to engage and disengage the modified hinge 916.

Embodiments of the present disclosure shown in the drawings and described above are example embodiments only and are not intended to limit the scope of the appended claims, including any equivalents as included within the scope of the claims. Various modifications are possible and will be readily apparent to the skilled person in the art. It is intended that any combination of non-mutually exclusive features described herein are within the scope of the present invention. That is, features of the described embodiments can be combined with any appropriate aspect described above and optional features of any one aspect can be combined with any other appropriate aspect. Similarly, features set forth in dependent claims can be combined with non-mutually exclusive features of other dependent claims, particularly where the dependent claims depend on the same independent claim. Single claim dependencies may have been used as practice in some jurisdictions require them, but this should not be taken to mean that the features in the dependent claims are mutually exclusive.

What is claimed is:

1. An infant care station comprising:

a wall of the infant care station, wherein the wall comprises a primary latch and at least one secondary latch comprising a hinge with at least one bottom pin and at least one top pin both extending in a parallel direction from a shared side of the hinge, wherein the infant care station is an incubator, a warmer, or a combination thereof;

one or more pin acceptors proximate the hinge, wherein the one or more pin acceptors hold the at least one bottom pin and the at least one top pin of the hinge in a closed position of the wall, and wherein the at least one top pin of the wall is released from the one or more pin acceptors in response to a force applied to the wall, wherein the one or more pin acceptors each comprise a groove of a predetermined configuration, and wherein the force comprises an upward force, a pulling force, or a combination thereof, and wherein the predetermined configuration comprises one or more regions of the groove that are narrower than at least one wider region of the groove.

2. The infant care station of claim 1, wherein the predetermined configuration comprises a higher region of the groove that is narrower than a lower region of the groove.

3. The infant care station of claim 1, wherein the top pin comprises a cylindrical shape and the bottom pin comprises at least one flat edge.

4. The infant care station of claim 1, wherein a second force in an upward direction applied to the wall in an open position results in the one or more bottom pins moving upward in the one or more pin acceptors, and wherein the wall is detached from the infant care station in response to the one or more bottom pins exiting a top of each of the one or more pin acceptors.

5. The infant care station of claim 1, wherein the hinge, the at least one bottom pin, or the at least one top pin comprises at least one section to break in response to a predetermined breaking force that exceeds a threshold.

6. The infant care station of claim 1, wherein the at least one bottom pin, the at least one top pin, or a combination thereof, comprises a single pin that is inserted into a hollow space of the hinge.

7. The infant care station of claim 1, wherein the at least one bottom pin comprises a first bottom pin on a first side of the hinge and a second bottom pin on a second side of the hinge, and wherein the at least one top pin comprises a first top pin on the first side of the hinge and a second top pin on the second side of the hinge.

8. The infant care station of claim 1, wherein the at least one bottom pin or the at least one top pin is a push-release type pin.

9. An infant care station comprising:

a wall of the infant care station, wherein the wall comprises a primary latch and a secondary latch comprising a hinge with at least one bottom pin and at least one top pin both extending in a parallel direction from a shared side of the hinge, wherein the infant care station is an incubator, a warmer, or a combination thereof;

a pin acceptor proximate the hinge, wherein the pin acceptor houses the at least one bottom pin and the at least one top pin of the hinge in a closed position of the wall, wherein the at least one top pin of the wall is released from the pin acceptor in response to a pulling force applied to the wall, and wherein a second force in an upward direction applied to the wall in an open position results in the one or more bottom pins moving upward in the pin acceptor, and wherein the wall is detached from the infant care station in response to the one or more bottom pins exiting a top of the pin acceptor, wherein the pin acceptor comprises a groove, wherein a higher region of the groove is narrower than a lower region of the groove.

10. The infant care station of claim 9, wherein the top pin comprises a cylindrical shape and the bottom pin comprises at least one flat edge.

11. The infant care station of claim 9, wherein the hinge, the at least one bottom pin, or the at least one top pin comprises at least one section to break in response to a predetermined breaking force that exceeds a threshold.

12. The infant care station of claim 9, wherein the at least one bottom pin, the at least one top pin, or a combination thereof, comprises a single pin inserted into a hollow space of the hinge.

13. The infant care station of claim 9, wherein the at least one bottom pin comprises a first bottom pin on a first side of the hinge and a second bottom pin on a second side of the hinge, and wherein the at least one top pin comprises a first top pin on the first side of the hinge and a second top pin on the second side of the hinge.

14. The infant care station of claim 9, comprising a second pin acceptor with a second groove, wherein one or more regions of the second groove are narrower than at least one wider region of the second groove.

15. An infant care station comprising:

a wall of the infant care station, wherein the wall comprises a primary latch and a secondary latch comprising a hinge with at least one bottom pin and at least one top pin;

a pin acceptor proximate the hinge, wherein the pin acceptor houses the at least one bottom pin and the at least one top pin of the hinge in a closed position of the wall, wherein the at least one top pin of the wall is released from the pin acceptor in response to a pulling force applied to the wall, and wherein a second force in an upward direction applied to the wall in an open position results in the one or more bottom pins moving upward in the pin acceptor, and wherein the wall is detached from the infant care station in response to the one or more bottom pins exiting a top of the pin acceptor, wherein the pin acceptor comprises a groove, wherein a higher region of the groove is narrower than a lower region of the groove.

16. The infant care station of claim 15, wherein the at least one bottom pin, the at least one top pin, or a combination thereof, comprises a single pin inserted into a hollow space of the hinge.

17. The infant care station of claim 15, wherein the hinge, the at least one bottom pin, or the at least one top pin comprises at least one section to break in response to a predetermined breaking force that exceeds a threshold.

* * * * *